US011585136B2

(12) United States Patent
Rupp et al.

(10) Patent No.: US 11,585,136 B2
(45) Date of Patent: Feb. 21, 2023

(54) GUIDE SYSTEM FOR A DOOR ASSEMBLY, DOOR ASSEMBLY, AND DEVICE ASSEMBLY

(71) Applicant: Julius Blum GmbH, Hoechst (AT)

(72) Inventors: Matthias Rupp, Hohenweiler (AT); Christian Hauer, Hoerbranz (AT); Hermann Haemmerle, Lustenau (AT); Ingo Gasser, Hoechst (AT)

(73) Assignee: JULIUS BLUM GMBH, Hoechst (AT)

( * ) Notice: Subject to any disclaimer, the term of this patent is extended or adjusted under 35 U.S.C. 154(b) by 866 days.

(21) Appl. No.: 16/509,051

(22) Filed: Jul. 11, 2019

(65) Prior Publication Data

US 2019/0330897 A1 Oct. 31, 2019

Related U.S. Application Data

(63) Continuation of application No. PCT/AT2017/060347, filed on Dec. 22, 2017.

(30) Foreign Application Priority Data

Jan. 13, 2017 (AT) ..... A 50025/2017

(51) Int. Cl.
*E05D 15/26* (2006.01)
*E06B 3/48* (2006.01)
(Continued)

(52) U.S. Cl.
CPC ..... *E05D 15/264* (2013.01); *E05D 15/58* (2013.01); *E06B 3/482* (2013.01); *E06B 3/5045* (2013.01); *E05Y 2900/212* (2013.01)

(58) Field of Classification Search
CPC ..... E05D 15/264; E05D 15/58; E06B 3/482; E06B 3/5045; E05Y 2900/212
See application file for complete search history.

(56) References Cited

U.S. PATENT DOCUMENTS 2,807,835 A 10/1957 Weise
3,342,246 A * 9/1967 Reiss ..... B63B 19/19 160/195
(Continued)

FOREIGN PATENT DOCUMENTS

CH 693 070 2/2003
CN 101490355 7/2009
(Continued)

OTHER PUBLICATIONS

International Search Report dated Feb. 26, 2018 in International (PCT) Application No. PCT/AT2017/060347.
(Continued)

*Primary Examiner* — Justin B Rephann
(74) *Attorney, Agent, or Firm* — Wenderoth, Lind & Ponack, L.L.P.

(57) ABSTRACT

A guide system for a door assembly including a door, which door can be attached to the guide system in a pivotal manner, has a closed position in which at least one device object can be covered on the front side and a parked position in which the door can be moved, preferably slid, in a direction transversely to the front of the at least one device object, preferably into a lateral receiving shaft, by the guide system. The guide system for the door is assembled or formed on a support structure separate from the device object to be covered, the support structure having at least one stand surface for standing on the floor of a room and/or at least one assembly device for assembling on the wall of a room.

28 Claims, 19 Drawing Sheets

(51) Int. Cl.
*E06B 3/50* (2006.01)
*E05D 15/58* (2006.01)

(56) References Cited

U.S. PATENT DOCUMENTS

| | | | | |
|---|---|---|---|---|
| 3,456,995 | A * | 7/1969 | Nyquist | E06B 3/5045 312/331 |
| 5,072,768 | A * | 12/1991 | Bonetti | E06B 3/5045 160/199 |
| 6,056,376 | A * | 5/2000 | Yenglin | E05D 15/58 312/138.1 |
| 6,848,758 | B1 * | 2/2005 | Yeh | F16B 12/24 312/258 |
| 7,261,100 | B2 | 8/2007 | Bartmann et al. | |
| 7,322,661 | B1 * | 1/2008 | Salvesen | E05D 15/58 312/298 |
| 7,478,892 | B2 * | 1/2009 | Punzel | A47B 81/005 312/351 |
| 7,524,002 | B2 * | 4/2009 | Punzel | A47B 81/005 312/215 |
| 7,896,425 | B2 | 3/2011 | Elliott et al. | |
| 8,303,056 | B2 | 11/2012 | Giorgi | |
| 8,500,224 | B2 | 8/2013 | Moeller | |
| 9,068,386 | B2 | 6/2015 | Ishii et al. | |
| 10,400,493 | B2 | 9/2019 | Gabl | |
| 2005/0134158 | A1 | 6/2005 | Bartmann et al. | |
| 2006/0255699 | A1 * | 11/2006 | Punzel | A47B 81/005 312/217 |
| 2007/0159037 | A1 * | 7/2007 | Hoffman | E05D 15/58 312/322 |
| 2009/0079308 | A1 * | 3/2009 | Punzel | F41C 33/06 312/351 |
| 2010/0117500 | A1 | 5/2010 | Giorgi | |
| 2011/0010998 | A1 | 1/2011 | Elliott et al. | |
| 2011/0175509 | A1 | 7/2011 | Moeller | |
| 2013/0232878 | A1 * | 9/2013 | Bortoluzzi | E05D 15/58 49/252 |
| 2015/0008811 | A1 * | 1/2015 | Ishii | E06B 3/5045 312/322 |
| 2017/0260789 | A1 | 9/2017 | Gabl | |

FOREIGN PATENT DOCUMENTS

| | | |
|---|---|---|
| DE | 28 17 161 | 10/1979 |
| DE | 689 03 285 | 4/1993 |
| DE | 199 02 918 | 8/1999 |
| EP | 2 345 347 | 7/2011 |
| JP | 5-133115 | 5/1993 |
| JP | 2002-276056 | 9/2002 |
| JP | 5587502 | 8/2014 |
| WO | 03/073003 | 9/2003 |
| WO | 2016/081963 | 6/2016 |

OTHER PUBLICATIONS

English translation of Search Report dated Jan. 29, 2019 in Taiwanese Application No. 107100621.
Search Report dated Nov. 21, 2017 in Austian Application No. A 50025/2017, with English translation.

* cited by examiner

GUIDE SYSTEM FOR A DOOR ASSEMBLY, DOOR ASSEMBLY, AND DEVICE ASSEMBLY

BACKGROUND OF THE INVENTION

The invention concerns a guide system for a door assembly comprising a door which can be mounted pivotably to the guide system, with a closed position in which at least one furniture item can be covered at the front side, and a parked position into which the door is moveable, preferably slidably, by means of the guide system in a direction transversely relative to a front of the at least one furniture item—preferably into a lateral receiving shaft. The invention further concerns a door arrangement comprising such a guide system and a furniture arrangement comprising such a door arrangement. Finally the invention also concerns a method of mounting a furniture arrangement.

Usually furniture carcasses are closed by pivotal doors or sliding doors. The disadvantage there is that in the opened state the doors also project into the room or in the case of sliding doors they do not allow complete opening. To counteract that there is already the proposal that the doors are firstly moved to the side and then slid into a lateral receiving shaft oriented perpendicularly to the front of the furniture carcass (for example CH 693070 A5).

In the known solution the receiving shaft is integrated in the furniture carcass. This therefore involves a special furniture carcass. In that respect there are two variants: in a first variant this involves a pivotal door which, after being pulled out of the shaft, is simply pivotable about a vertical pivot axis to close the furniture carcass. In a second variant this involves a folding door which, after being pulled out of the shaft, can be unfolded, wherein the two leaves of the folding door are pivotably connected together by way of folding door hinges. It is possible therewith to cover a relatively large front surface of a furniture carcass. Nonetheless the door can be parked in space-saving fashion in the receiving shaft (parked position).

SUMMARY OF THE INVENTION

The object of the invention is to provide a guide system and a door arrangement as well as a corresponding furniture arrangement, with which the possible options in terms of closing and opening a front of one or more furniture items are enlarged in relation to the previously known solutions. The invention also seeks to provide a mounting method which can be quickly and efficiently carried out for a furniture arrangement.

With the guide system according to the invention, it is possible for standardized furniture carcasses, for example those involving a predetermined width modular design but also other furniture items like for example electrical appliances (white goods) to be covered at the front in the closed position and for then at least one door to be disposed in a lateral parked position, in particular in a receiving shaft. In that case the guide system or the door arrangement has an autonomous self-supporting structure which accordingly does not require any special design configuration for the furniture carcass itself. That is of significance in particular when using electrical appliances as the furniture item, which often do not have a closed surface for connecting a support structure of a lateral receiving shaft for the doors. The furniture carcasses also must not extend over the entire height of the door. It is for example also possible for only base cupboards to be covered at the front side or—as is usual in kitchens—for base cupboards and wall cupboards which are of a reduced depth in relation to the base cupboards to be covered.

Overall therefore in accordance with the basic idea of the invention the furniture items to be covered on the one hand and the guide systems or door arrangements on the other hand for covering same are substantially independent of each other, which does not exclude their also being connected together for safety purposes in a concluding fitment procedure. That invention however is in principle not necessary, in contrast to the state of the art.

The guide system according to the invention or the door arrangement according to the invention also allow two different mounting methods: on the one hand it is possible firstly for the door arrangement or the guide system to be placed on the floor of a room and/or mounted to the wall of a room and then for the furniture items (furniture carcasses and/or electrical appliances) to be set up laterally there beside. However the reverse mounting procedure is also possible, in which firstly the furniture items are set up in the room in particular to provide a line of items, and then a guide system according to the invention or a door arrangement according to the invention are fitted.

In both mounting methods placement of the furniture items on the one hand and the door arrangement according to the invention or the guide system according to the invention on the other hand are substantially independent of each other. That can therefore also take place at different moments in time. It is also possible to arrange for different suppliers for the furniture items on the one hand and for the guide systems or door arrangements on the other hand. For example it is possible for a furniture store or a kitchen manufacturer to supply the furniture items while the door arrangements or at least the guide system for such door arrangements are supplied by the fitment manufacturer.

The doors themselves can moreover also be delivered by the furniture store or kitchen manufacturer with a delivery of the guide system by the fitment manufacturer in order to be matched in design to the furniture items. At any event however the fitment manufacturer can independently supply the technology of the guide system. It will be appreciated however that there is also the possibility of the fitment manufacturer supplying his products to the furniture store and for the latter then to set up on site the entire furniture arrangement using one of the two above-described mounting methods.

BRIEF DESCRIPTION OF THE DRAWINGS

Further advantages and details of the invention are described more fully hereinafter by reference to the specific description.

DETAILED DESCRIPTION OF THE INVENTION

Figure 1:
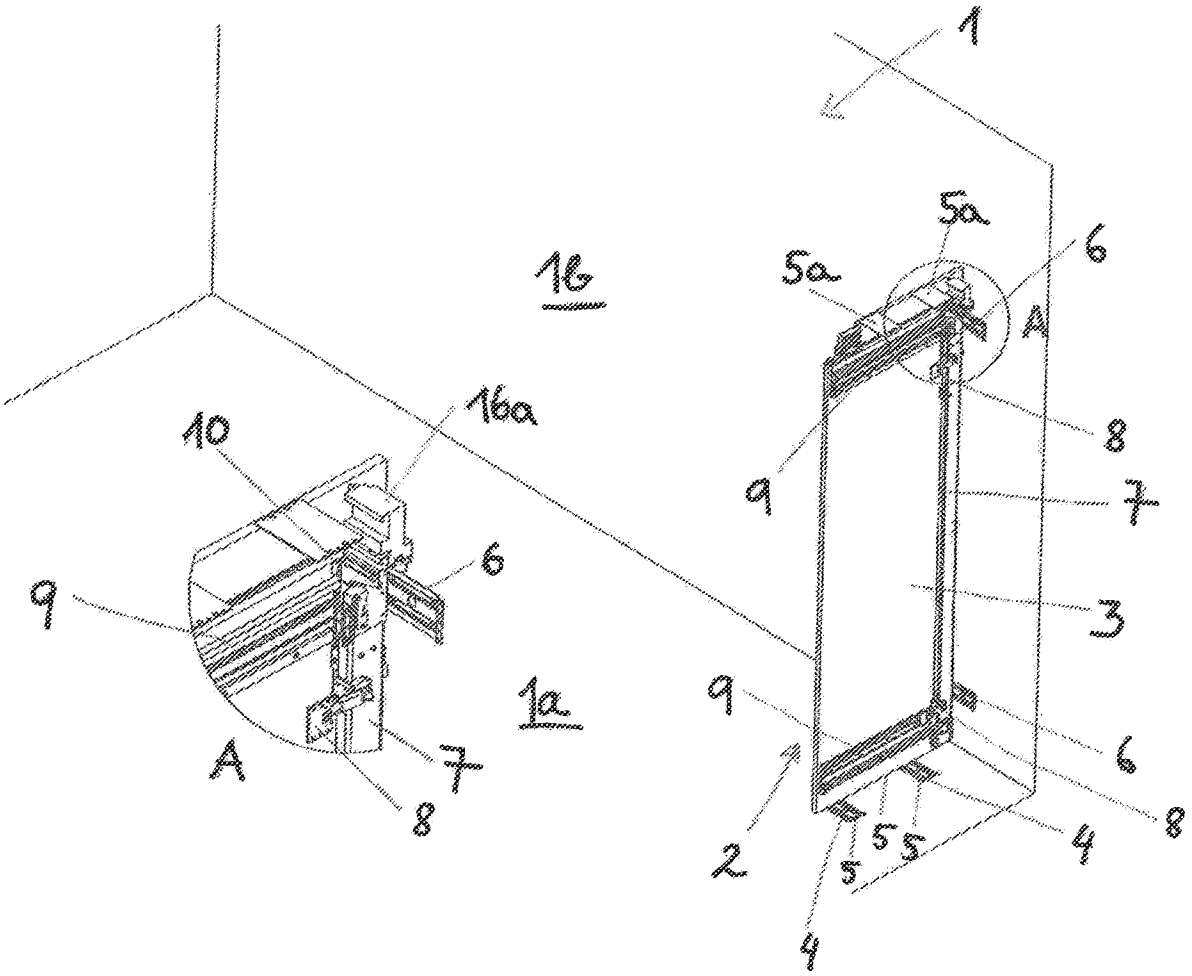
FIGS. 1 to 8 show in a diagrammatically indicated room a first embodiment of a guide system according to the invention, a door arrangement according to the invention or a furniture arrangement according to the invention, in a first variant of the method of mounting the furniture arrangement.

FIG. 1 shows generally denoted by reference 1 a room, for example a kitchen of a building. That room has a floor 1*a* and a wall 1*b*.

Figure 8:
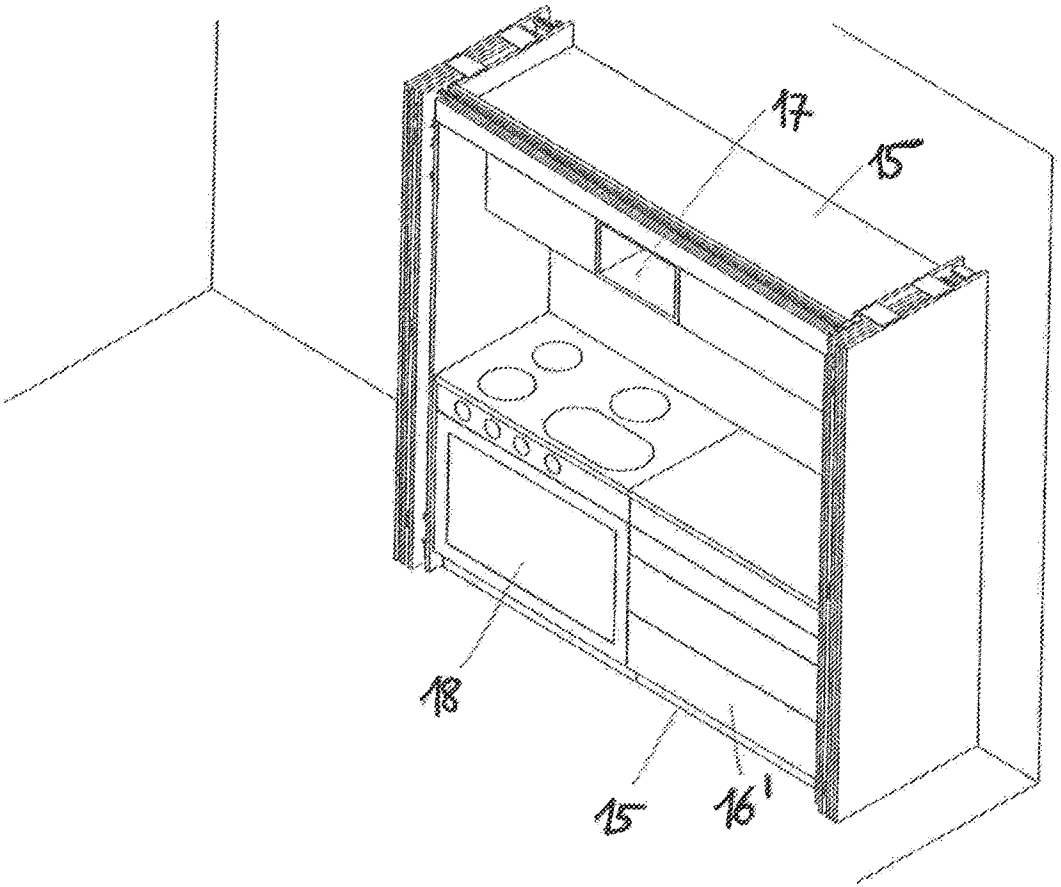
Figure 9:
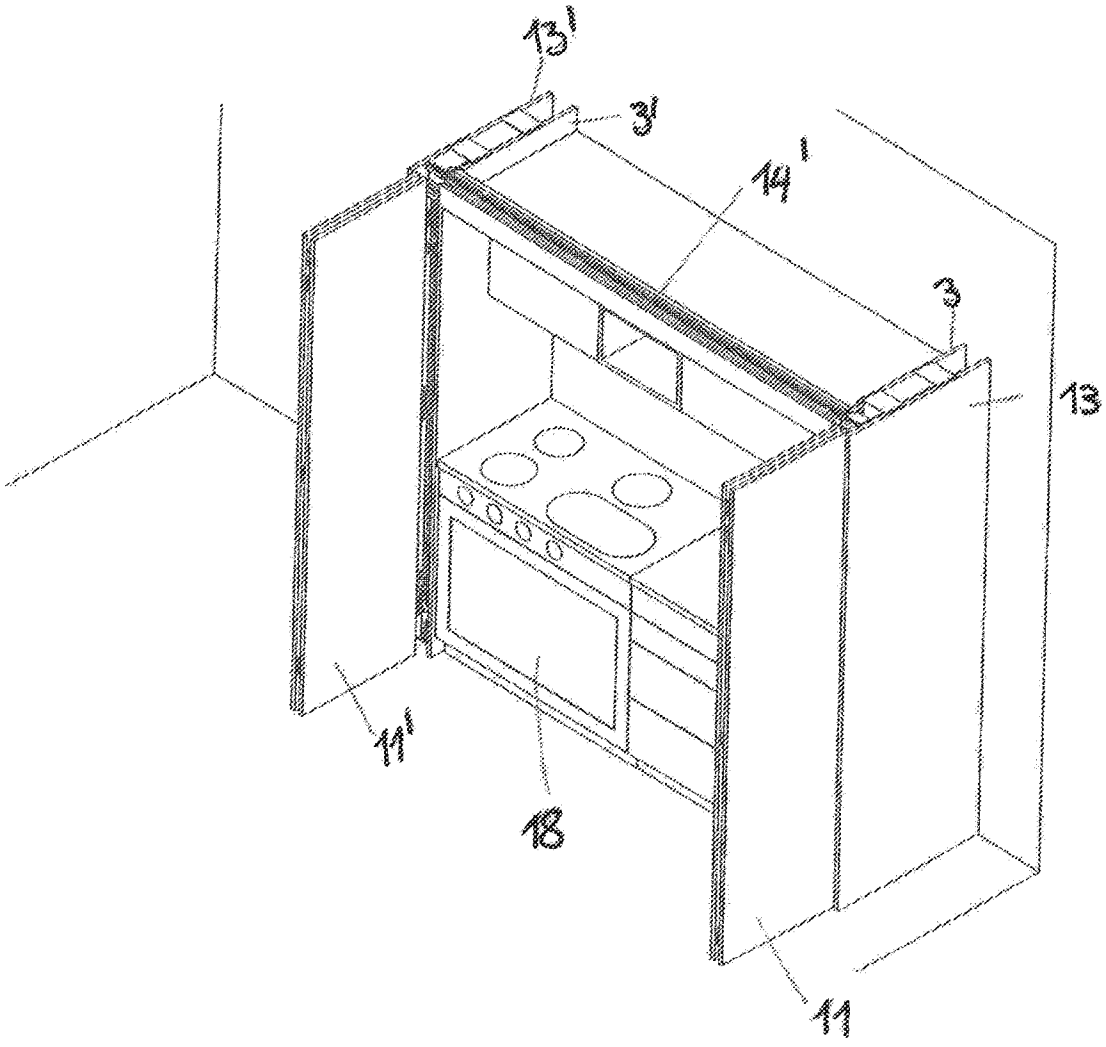
FIGS. 9 to 11 show, starting from the open position (parked position) shown in FIG. 1, closure of the doors in steps to the completely closed position of FIG. 11.
Figure 10:
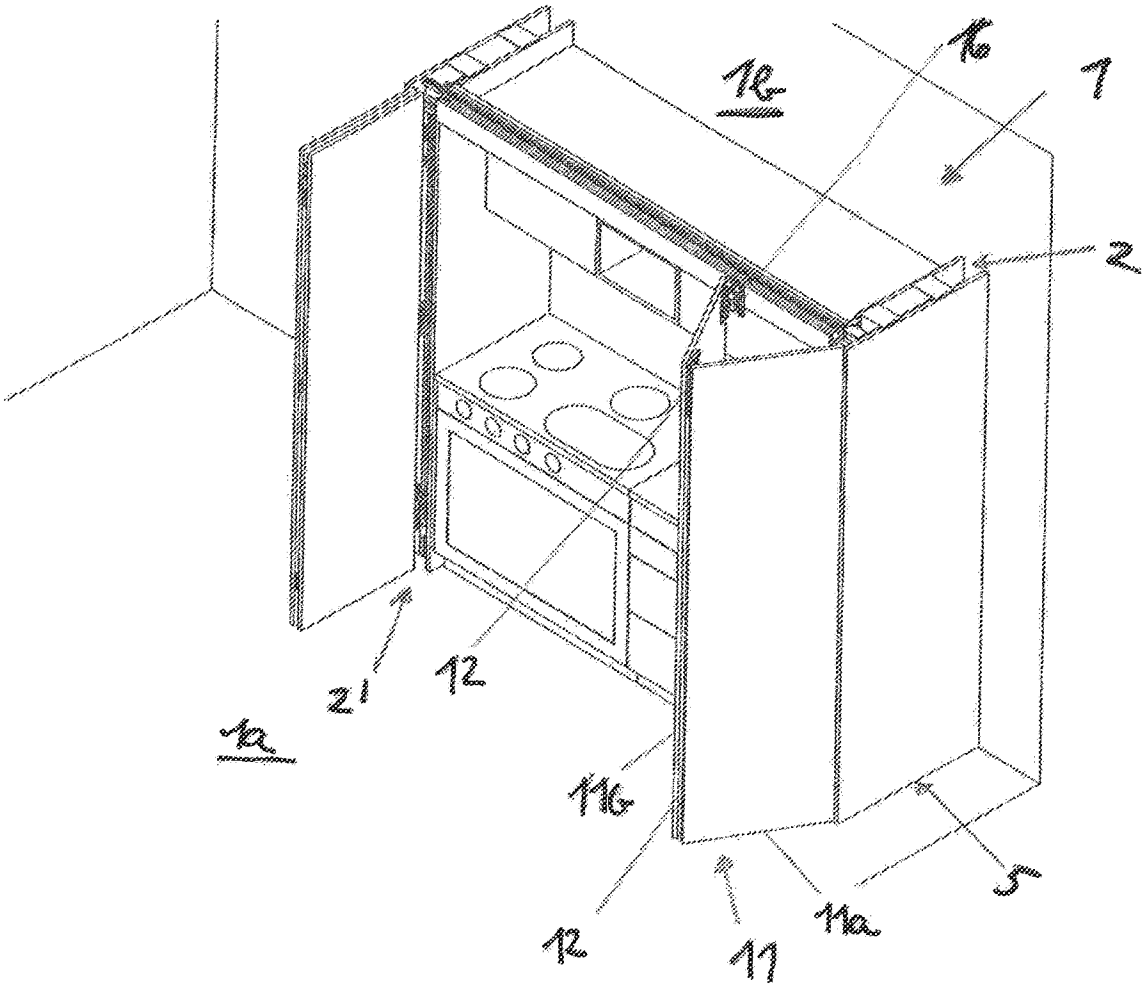

The embodiment shown there of a door system according to the invention for a door arrangement has a separate support structure, as shown in further succession in relation to furniture items 15, 15*a*, 15*b*, 18 shown in FIGS. 8 to 10, the support structure being generally denoted by reference 2 and in FIG. 1 already placed standing on the floor 1*a* or mounted in a condition of bearing against the wall 1*b*. For that purpose at the underside the support structure 2 has a vertically disposed substantially rectangular plate 3 and at angle mounting members 4 mounted thereto, a support surface 5 for standing on the floor 1*a* of the room 1.

As an alternative to that support surface at the underneath, a mounting device 6 in the form of angle mounting members can also be provided laterally, for mounting to the wall, which can be fixed by way of suitable fixing means, for example screws and dowels, in the wall.

In the illustrated embodiment there is both a support surface 5 for standing on the floor 1*a* and also a mounting device 6 for mounting to the wall 1*b*. It is however in principle sufficient if one of those two options (support surface, mounting device on the wall) is provided.

At any event the support surface or the mounting device for mounting to the wall 1*b* allow the essential technical parts of the guide system which are described in greater detail hereinafter to be mounted in the room 1 in a secure position independently of at least one furniture item to be covered, as shown in FIG. 1.

From the technical point of view the guide system shown in FIG. 1 in this embodiment has a vertically oriented pillar 7 on which a door (specifically a folding door) can be releasably fixed by way of hinges 8, as shown hereinafter in FIG. 3.

The region A identified by a circle in FIG. 1 is shown on the left in FIG. 1 on an enlarged scale.

The vertical pillar 7 which carries the hinges 8 is displaceable horizontally parallel to itself on horizontal rails 9 by means of rollers 10.

FIG. 1 shows the rear position of the pillar 7 corresponding to the later parked position of the door arrangement.

Figure 2:
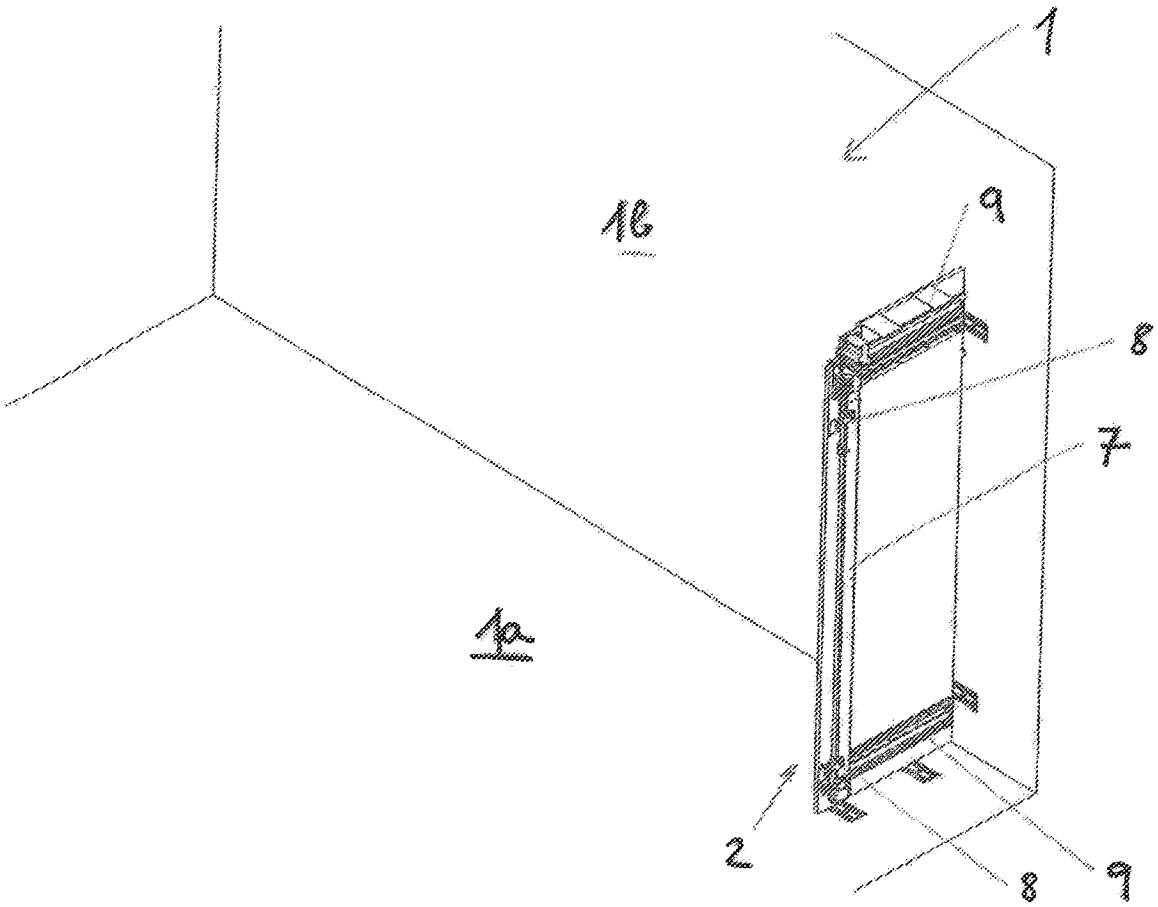

In FIG. 2 the pillar 7 is slid into the forward position from which the door arrangement can be moved by way of the hinges 8 into the closed position, as shown hereinafter.

Figure 3:
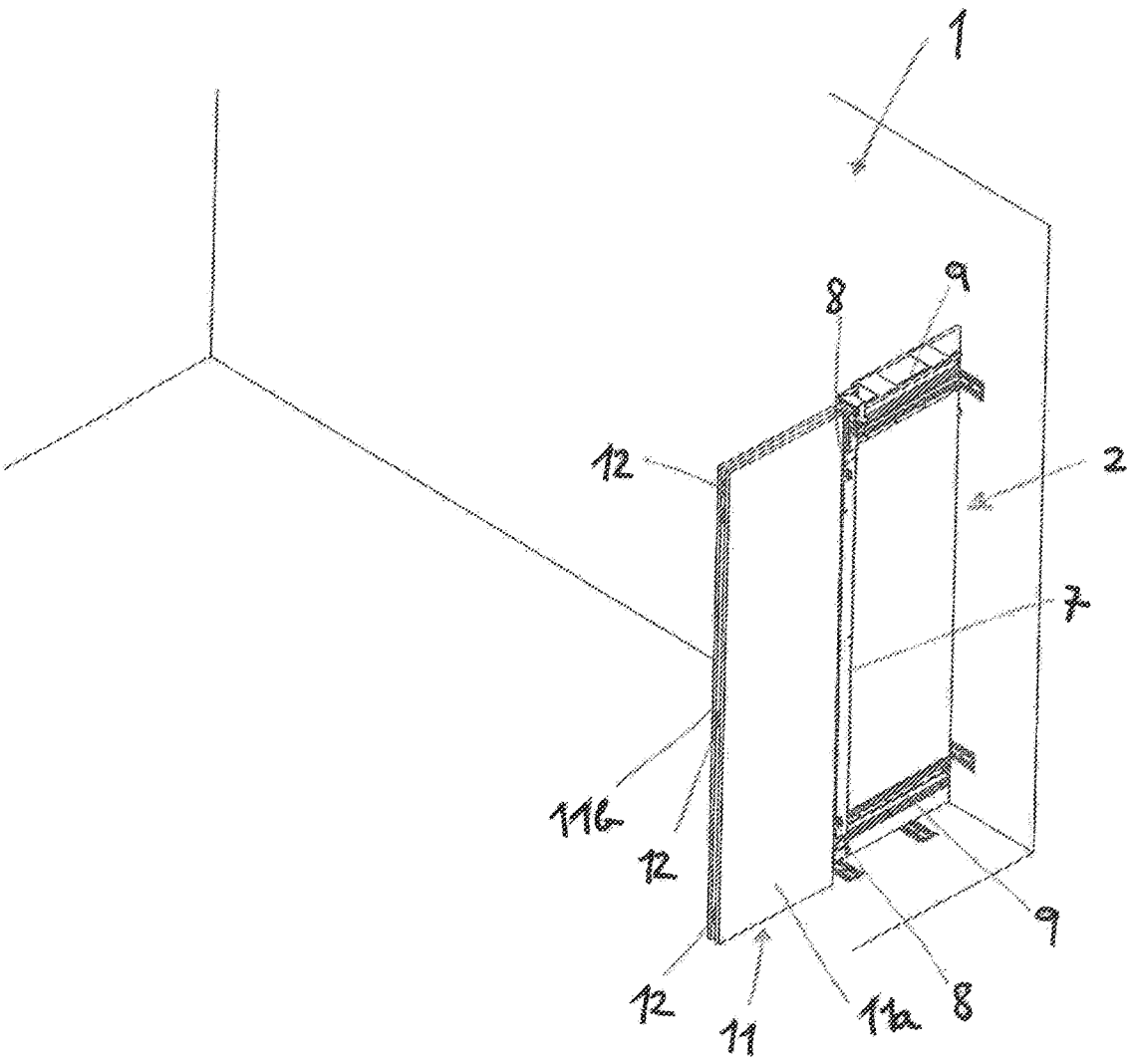

FIG. 3 now shows a folding door 11 comprising two door leaves 11*a* and 11*b* which are pivotably connected together by way of folding door hinges 12. Of that folding door 11 the door leaf 11*a* is pivotably connected to the hinges 8 of the pillar 7. That connection is also releasable, in that respect it is possible to provide on the door leaf 11*a* pre-fitted fitment portions which can be coupled to hinge arms of the hinges 8 in per se known manner.

Figure 4:
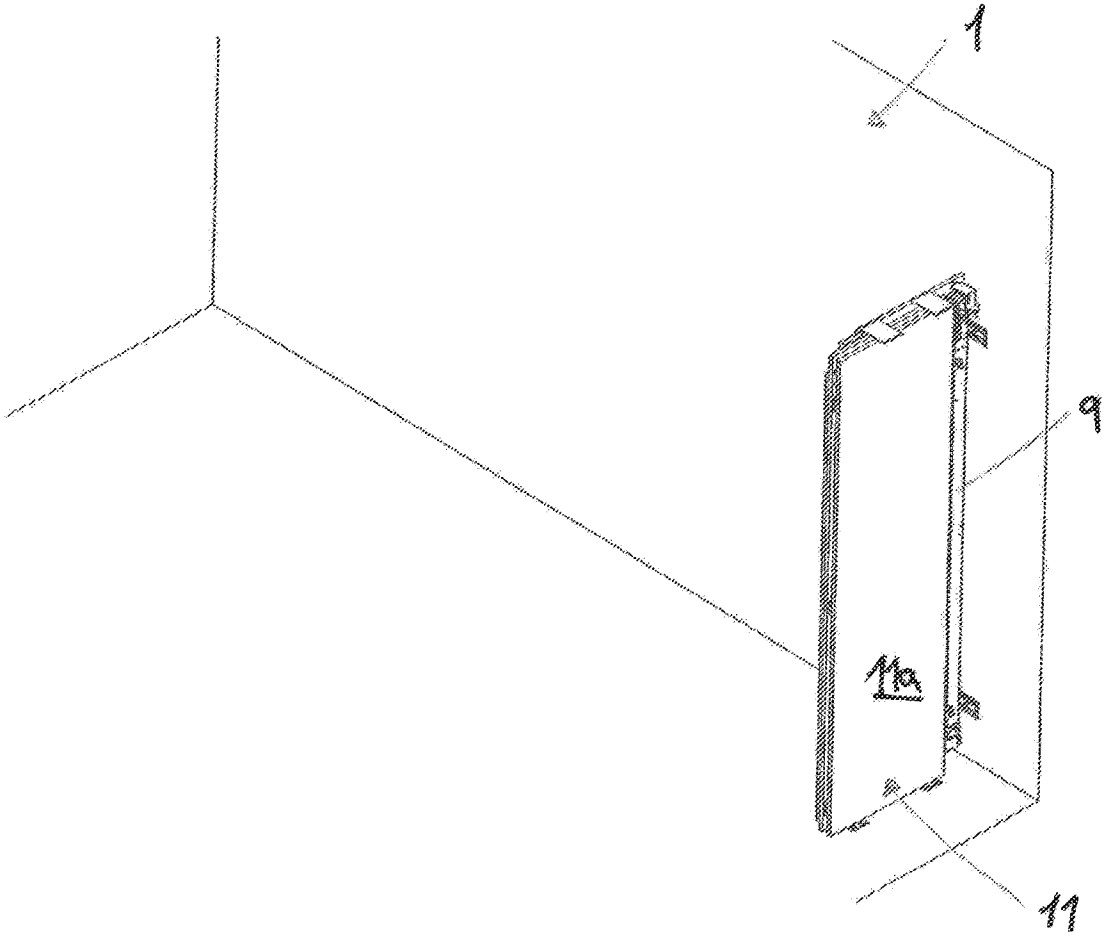

Then, starting from FIG. 3, FIG. 4 shows the folding door 11 which has been pushed into the parked position.

Figure 5:
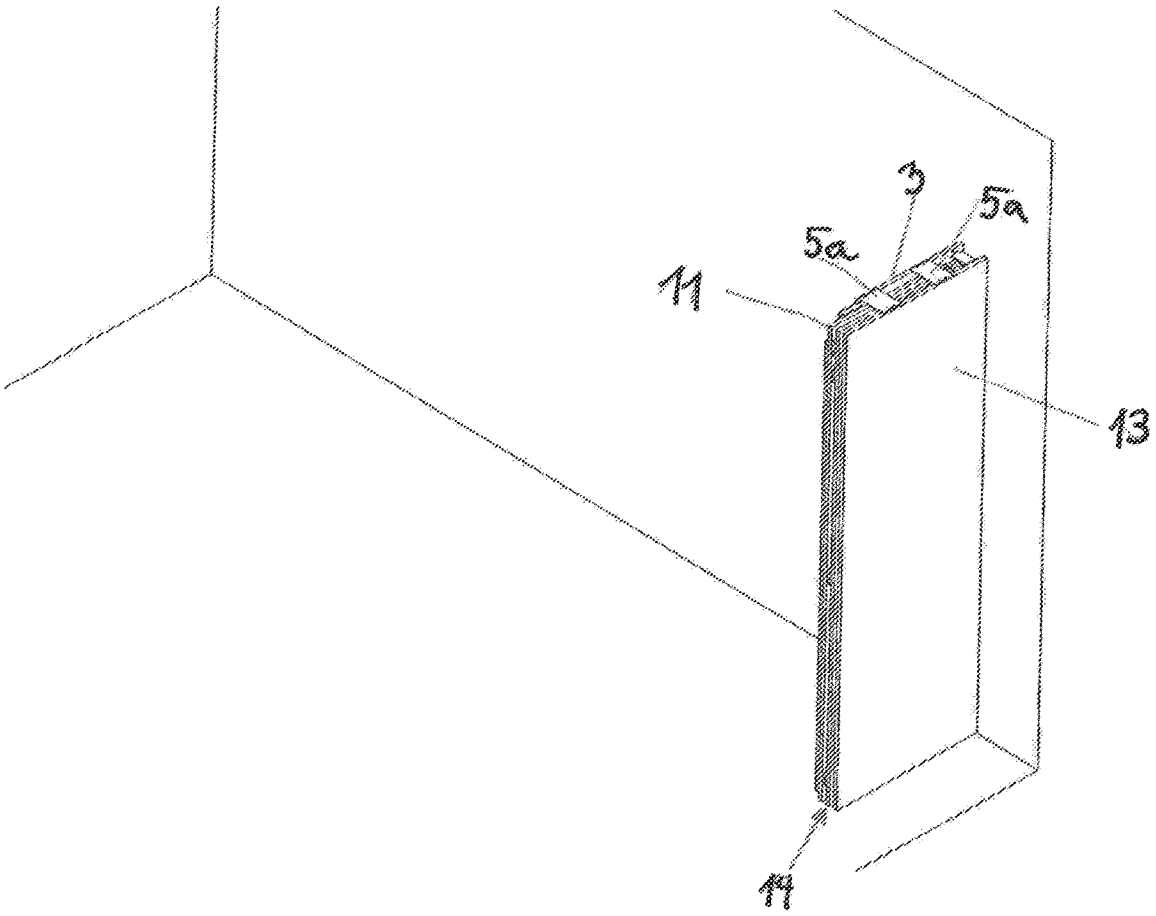

As FIG. 5 shows the door arrangement advantageously has a lateral cover plate 13 which is oriented parallel to the plate 3 and which can be connected by way of the angle members 5 on the floor, the angle members 5*a* on the ceiling and the mounting device 6 to the wall with the plate 3. It will be appreciated that other connecting options are also conceivable and possible, in particular those in which the connection does not take place by way of the floor angle members forming the support surface or the mounting device forming the mounting angle arrangement for mounting to the wall. It is important that between the two plates 3 and 13 there is a preferably relatively narrow receiving shaft 14 for the door 11 when in the parked position, as shown in FIG. 5.

In regard to the mounting procedure illustrated in FIGS. 1 to 5 it should also be mentioned that this was primarily so selected that the internal structure of the guide system can be clearly seen, for reasons relating to drawing visibility. It is certainly possible and also preferably provided that the lateral cover plate 13 is already fitted in advance, for example in the furniture store or even at the fitment manufacturer, in order to have a complete receiving shaft 14 with two lateral plates 3 and 13. In that case the door can also be already pre-fitted, but there is also the possibility of fitting it on site, which is generally to be preferred for reasons relating to transportation, because of the weight of the doors. In short, in contrast to the views in FIGS. 1 to 7, it is also possible for the doors to be hung only at the end, and that is even also possible after the furniture items have been installed, as shown in FIG. 8.

Figure 6:
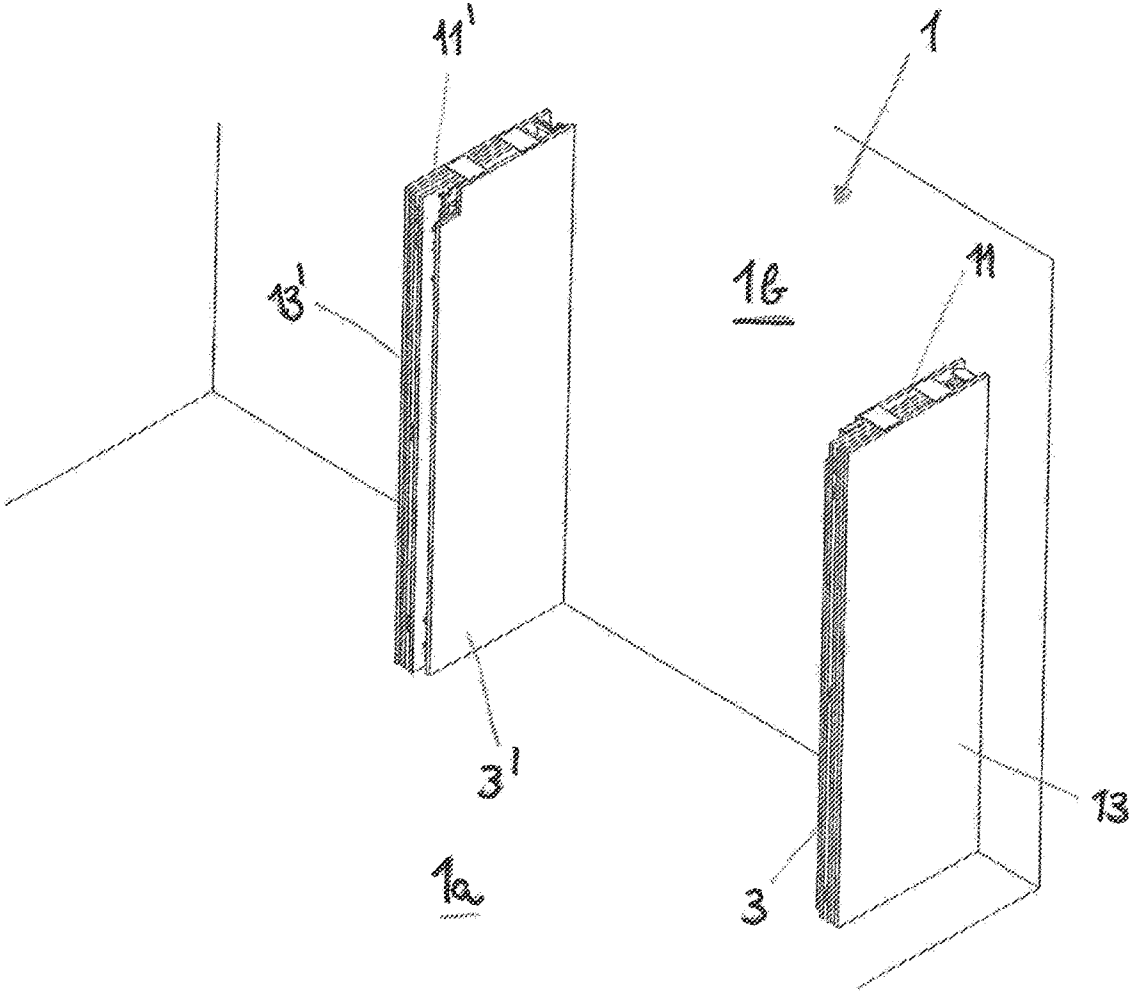

FIG. 6 shows a second guide system or a second door arrangement which is of a substantially mirror-image symmetrical configuration relative to the first door arrangement shown in FIG. 5 and is placed at a spacing therefrom in the room 1. The references of this second door arrangement or the second guide system have the addition of a prime (′), otherwise here the same references are used as for the first guide system and the first door arrangement respectively.

In FIG. 6 therefore firstly two guide systems or door arrangements are placed in the correct positions relative to each other at a predetermined spacing in the room 1 and then connected together with a horizontal rail 14′, on which a slide 16 arranged upwardly on the door leaf 11*b* of the folding door 11 or the folding door 11′ will be displaceable.

Figure 7:
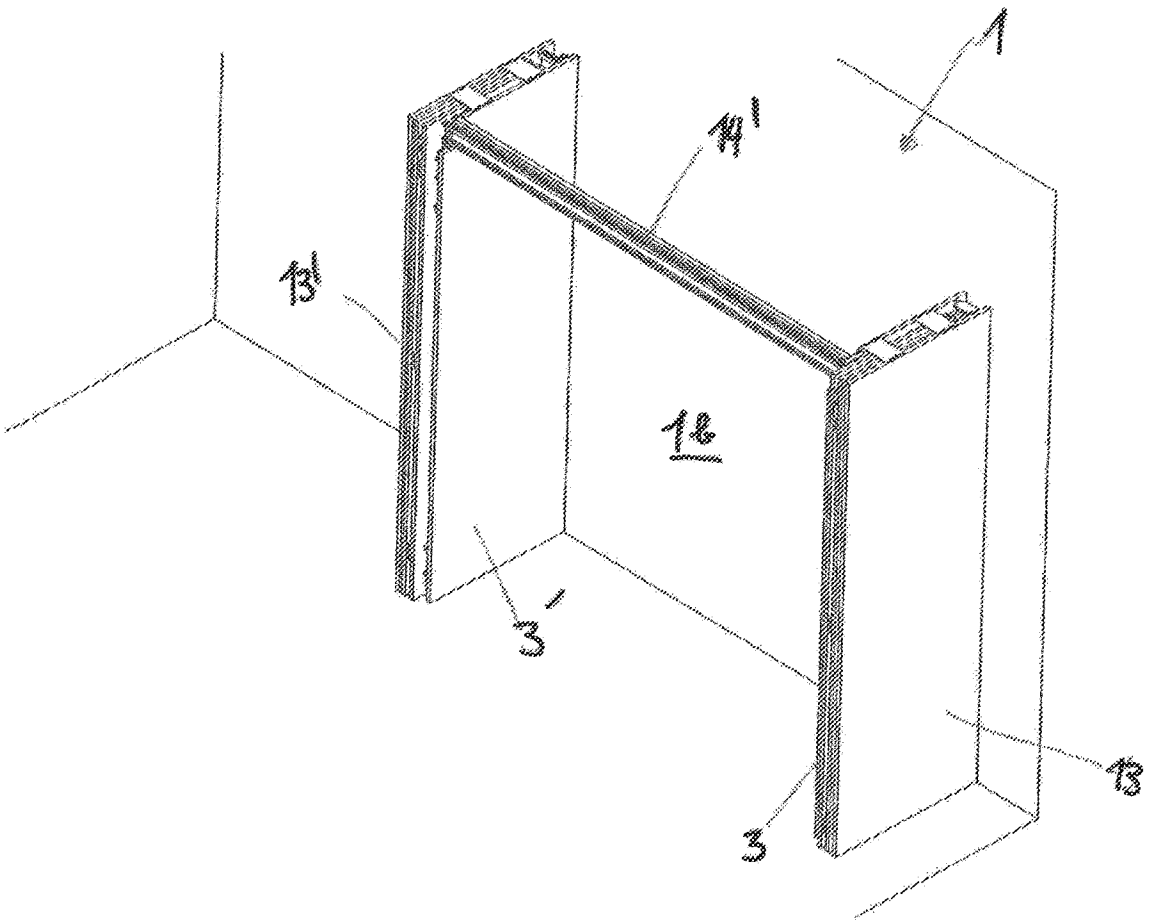

FIG. 7 shows an autonomous self-supporting support structure of a guide system or a door arrangement in accordance with the basic idea of the invention. Furniture items can now be arranged laterally beside the guide system or the door arrangement or in the space between the two door arrangements, completely independently of the autonomous guide system or the autonomous door arrangement, to provide a furniture arrangement according to the invention. In this respect the furniture items can be standard items which do not need to be of a particular configuration for storage of the after all quite complicated folding doors together with the receiving shaft. In particular the furniture items can have a furniture carcass 15 with two parallel vertical side walls, between which for example drawers 16′ or shelves 17 can be arranged. It is also possible, as shown in FIG. 8, to provide base cupboards which are of a great depth while wall cupboards hung on the wall are of a lesser depth.

Besides actual furniture carcasses it is also possible for the furniture items to include electrical appliances. In the present case the electrical appliance 18 is a cooker with an oven. Such electrical appliances generally do not laterally have a closed wall, this is also not necessary by virtue of the independent configuration according to the invention of the door arrangement, because precisely the door arrangement "stands" autonomously, as FIG. 7 shows.

Figure 11:
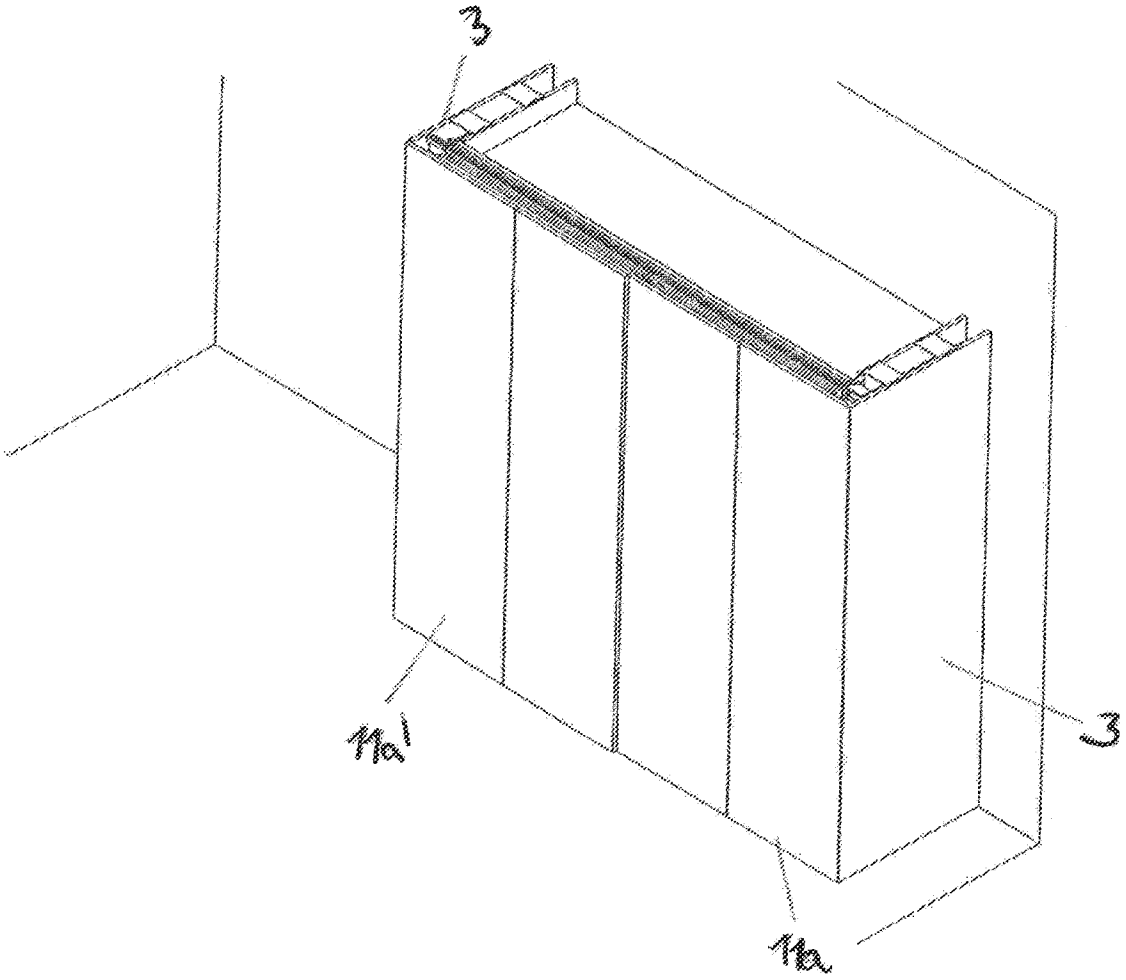

FIGS. 9 to 11 now show closure of the furniture arrangement, starting from the parked position in FIG. 8, in individual steps:

Firstly the folding doors 11 and 11' are drawn out of the respective receiving shaft between the plates 3, 13 on the one hand and 3', 13' on the other hand, in which case the pillar 7 moves forwardly on the guide rails 9. The slide 16 at the respective inner door leaf of the folding door is not shown in FIG. 9 but is clearly visible in FIG. 10. It can move in the horizontal rail 14, with the folding door 11 unfolding, that is to say the two door leaves 11*a* and 11*b* pivoting open by way of the folding door hinges 12. That is clearly shown at the right in FIG. 10.

Figure 12:
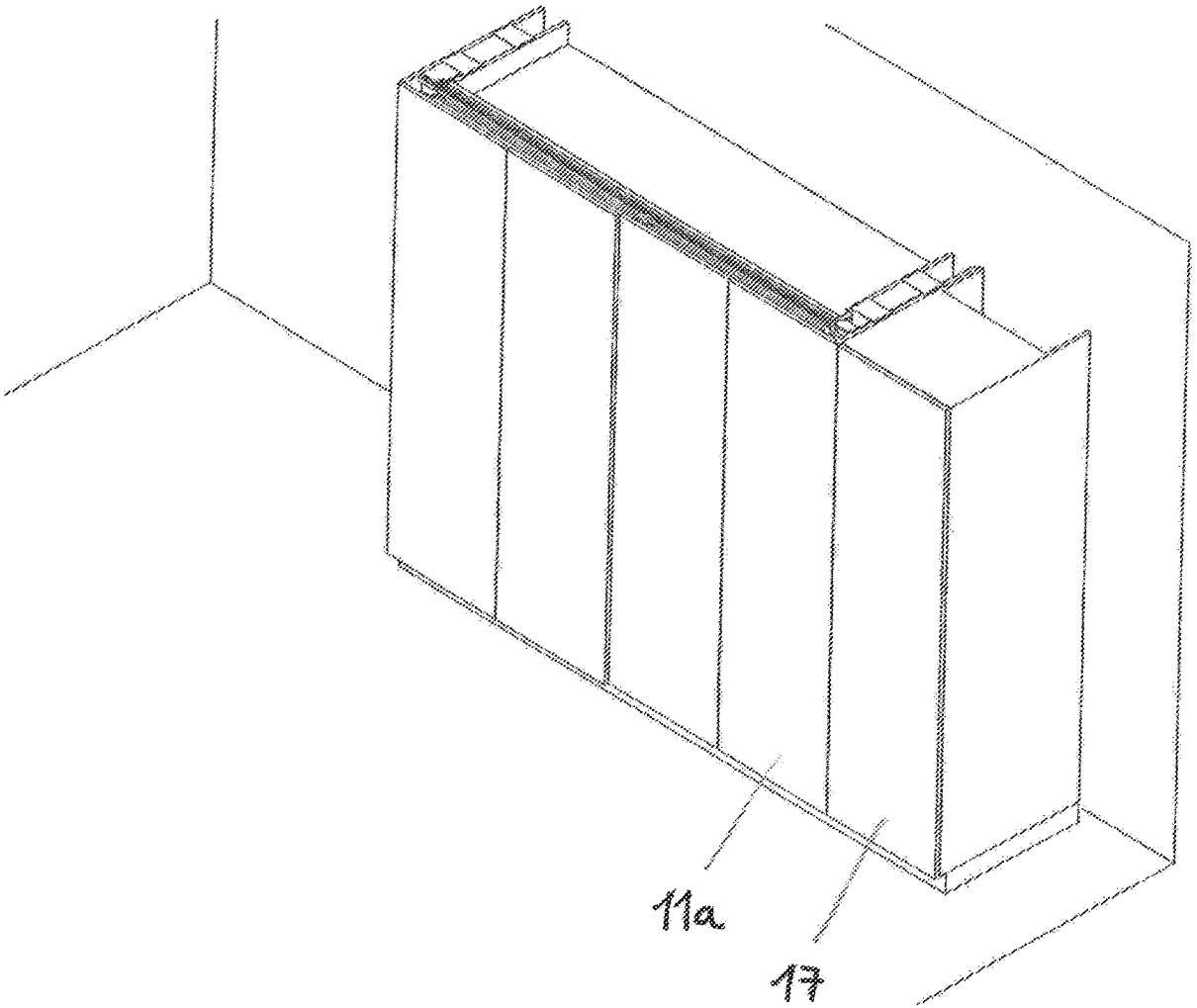
FIG. 12 shows a further embodiment with an additional lateral furniture carcass (wall cupboard)

Finally FIG. 11 shows the completely closed position in which it will also be seen that the door leaves 11*a* and 11*a'* completely cover the ends of the lateral plates 3 and 3' in the closed position, which permits a homogeneous continuous appearance from the front. It is thus also possible to laterally connect a further furniture carcass, for example in the form of a cupboard 17, without a visible gap, as shown in FIG. 12.

As regards to the movement of the folding door leaves 11*a*, 11*b* that can be done by hand, in which case recessed door handles (not shown here) are possible, which do not project or which can be folded in in order to permit the folding doors to be pushed into the associated receiving shaft.

It is also possible that such movement is at least partially assisted by force storage means (springs) (not shown). In particular it is possible to provide a spring-loaded touch latch device which, when the folding doors disposed in the shaft are over-pushed rearwardly, it causes them to move forwardly under a spring loading so that they can be better gripped with the hand. The further closing movement can then be performed by hand. It is however also possible for spreading springs to be provided in the hinges 8 or in the folding door hinges 12, to assist with the closing movement. In principle it is also possible for the drive to be electrically assisted or for it to be completely electrically driven. All those drive variants are conceivable and possible.

Figure 13:
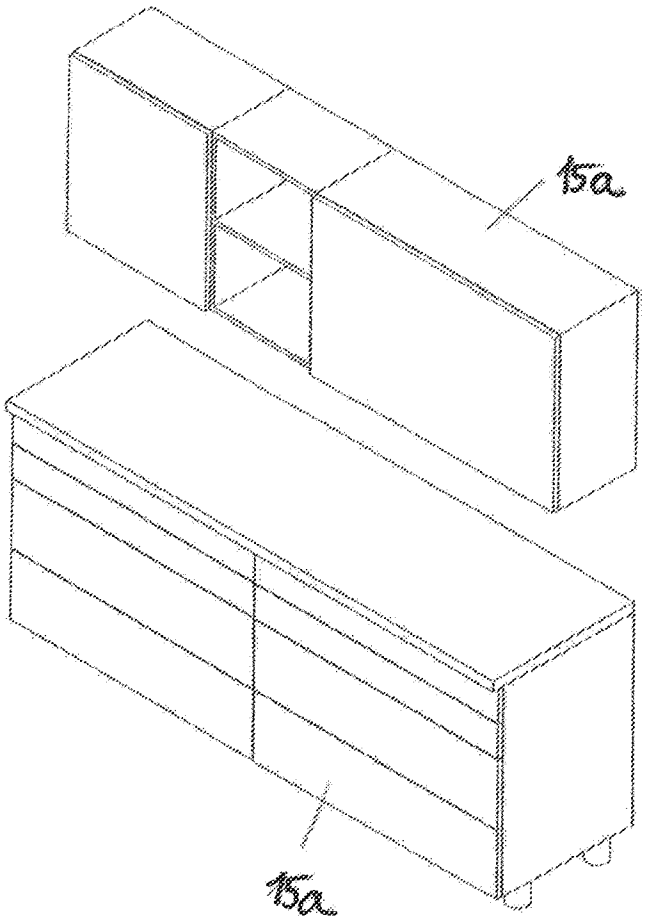
FIGS. 13 to 16 show similar views to FIGS. 1 to 8 of a second variant of the mounting procedure in which firstly the furniture items and then the guide system or the door arrangements are set up or fitted.
Figure 14:
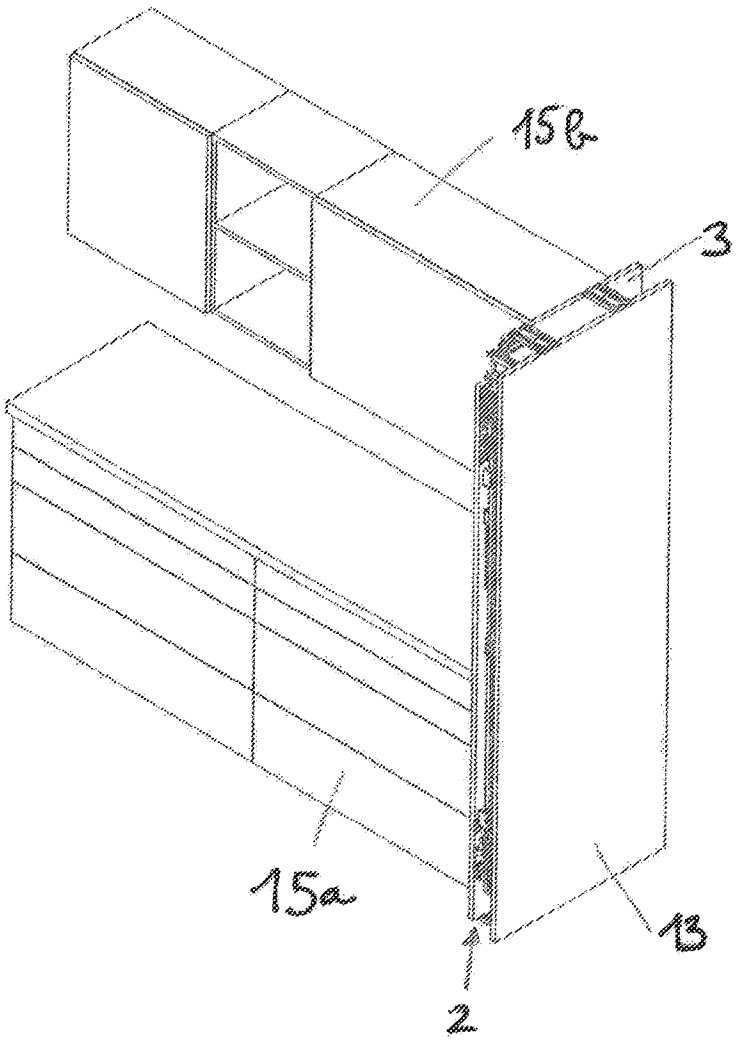
Figure 15:
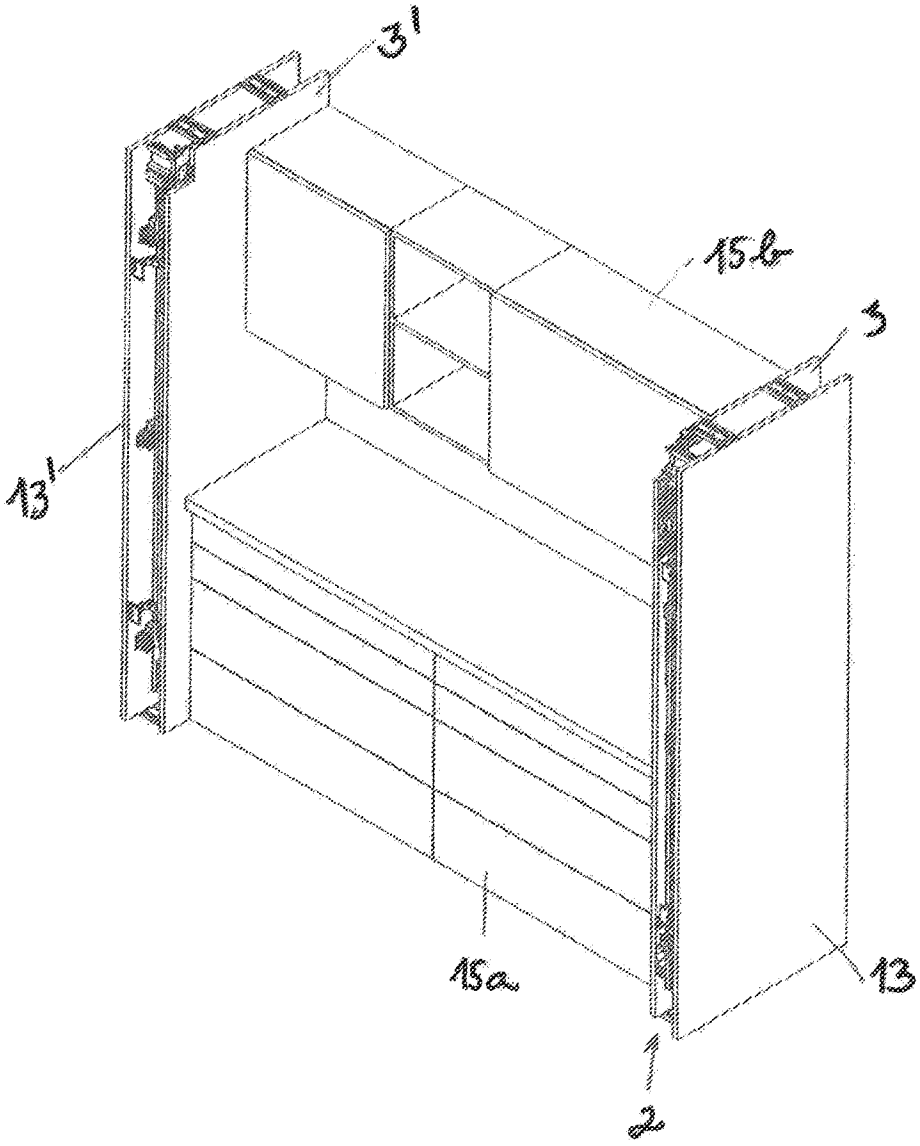

FIGS. 13 to 16 now show an alternative reversed mounting procedure which is possible in accordance with a further preferred method of the invention. Here, in a room, similarly as shown in the preceding Figures, firstly the preferably standardised furniture carcasses in the form of a base cupboard 15*a* and a wall cupboard 15*b* are set in position (FIG. 13). Then, as shown in FIGS. 14 and 15, embodiments of the guide system according to the invention are set up with their vertical plates 3 and 3' at the left and at the right, as shown in FIGS. 14 and 15.

Here too those units can be supplied in pre-assembled form in the form of receiving shafts in order to permit rapid fitment. In that respect it is not necessary for them to be laterally connected in receiving shafts or "pockets" to the previously positioned furniture items 15*a*, 15*b*, although that can certainly happen. At any event the lateral "pockets" can also stand autonomously and can be fixed to the floor and/or to the wall.

Figure 16:
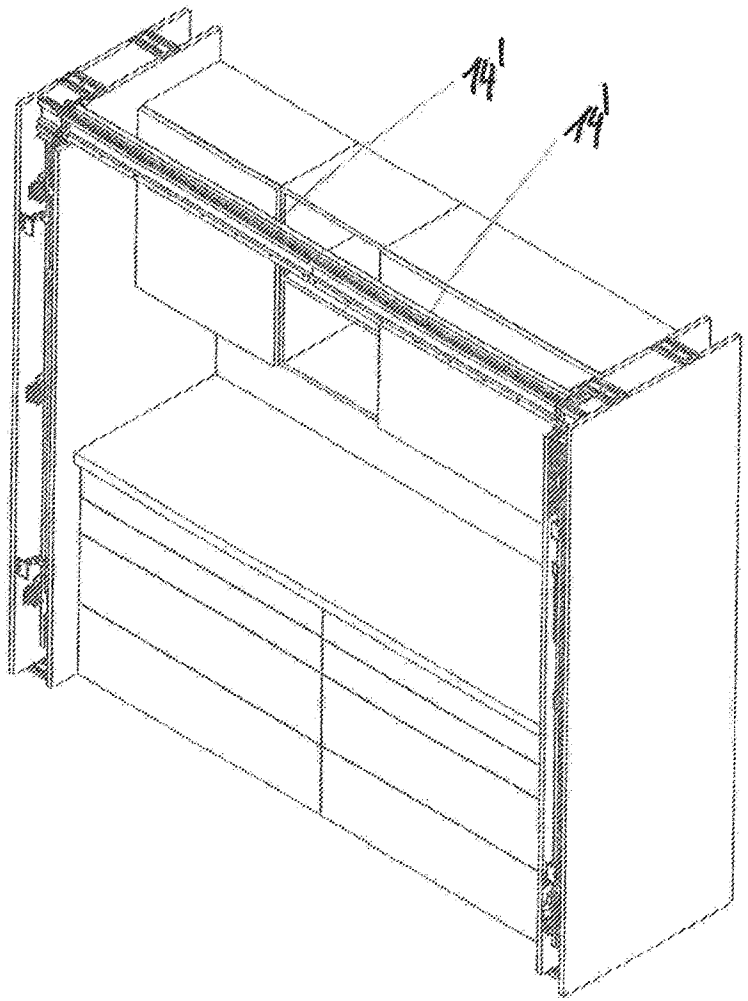
Figure 17:
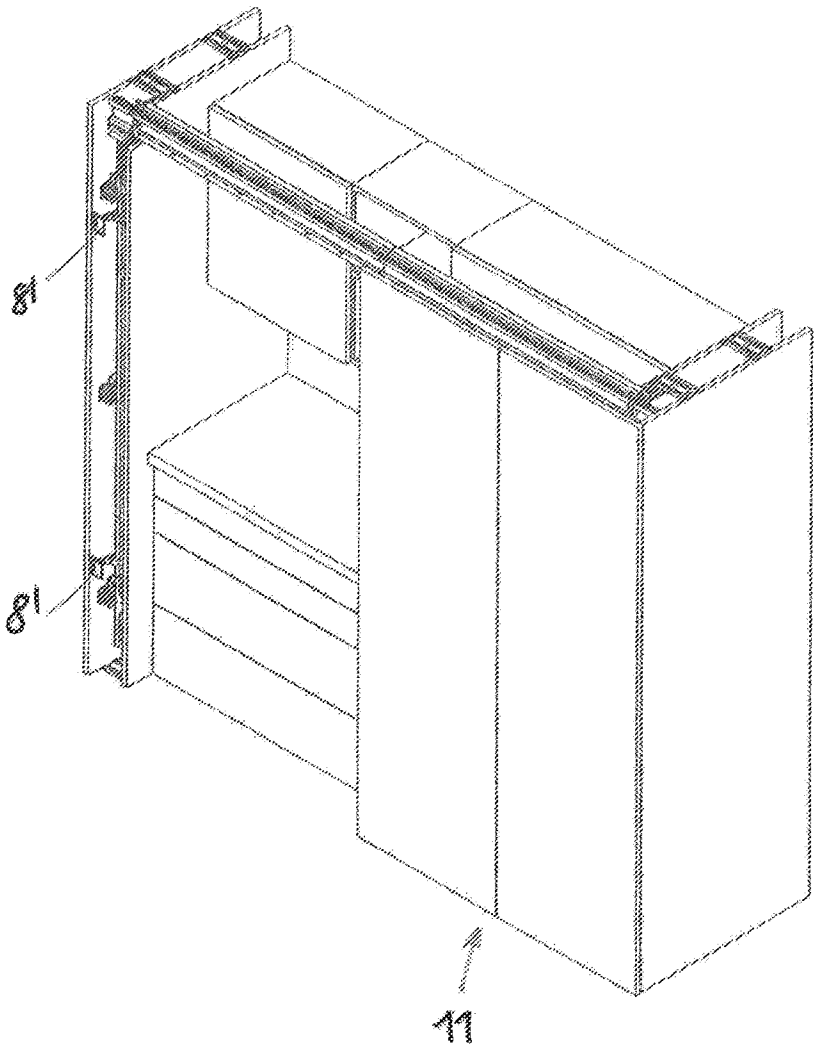
FIGS. 17 to 19 show, starting from the open position (parked position) shown in FIG. 16, closure in steps of the furniture arrangement until reaching the completely closed position in FIG. 19.
Figure 18:
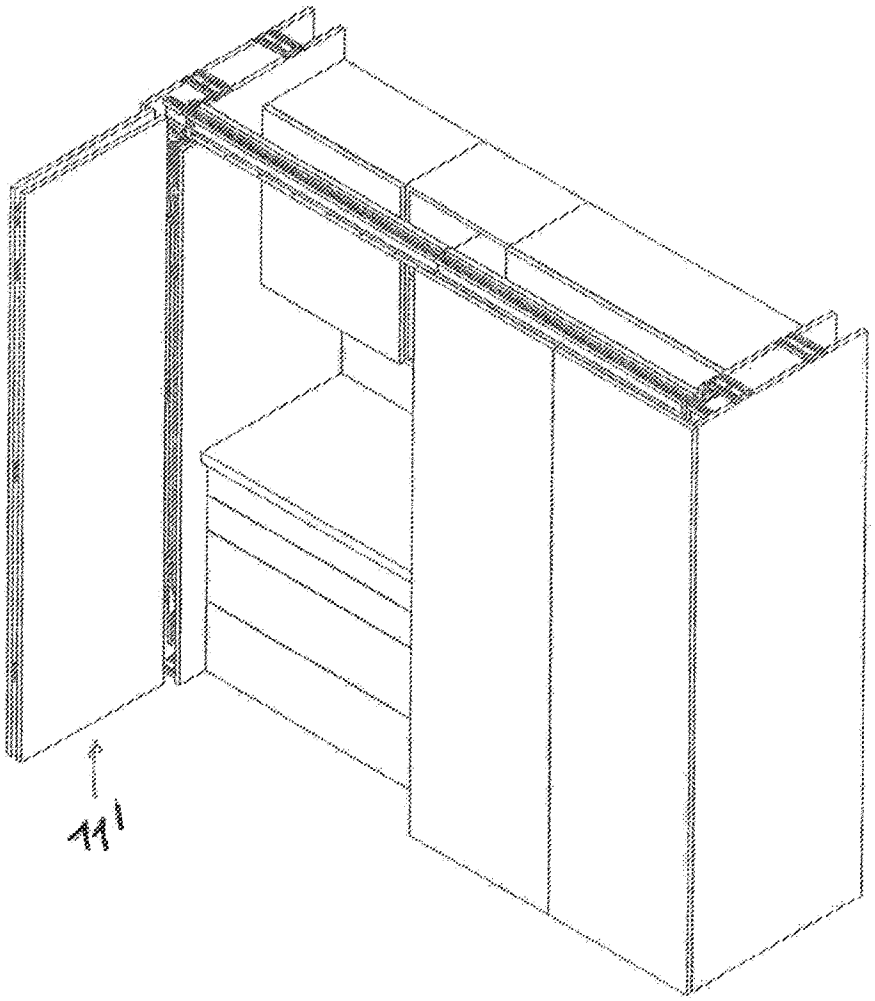

FIG. 16 then shows a further construction step in which the rail 14 which is preferably of a two-part configuration has been mounted in place. In FIG. 17 the right-hand folding door 11 is already fitted and closed. The left-hand folding door 11' is not yet fitted at the associated hinges 8'. That is only the case in FIG. 18, in which respect here the left-hand folding door 11' is in the position of being pulled out of shaft, but not yet in the closed position.

Figure 19:
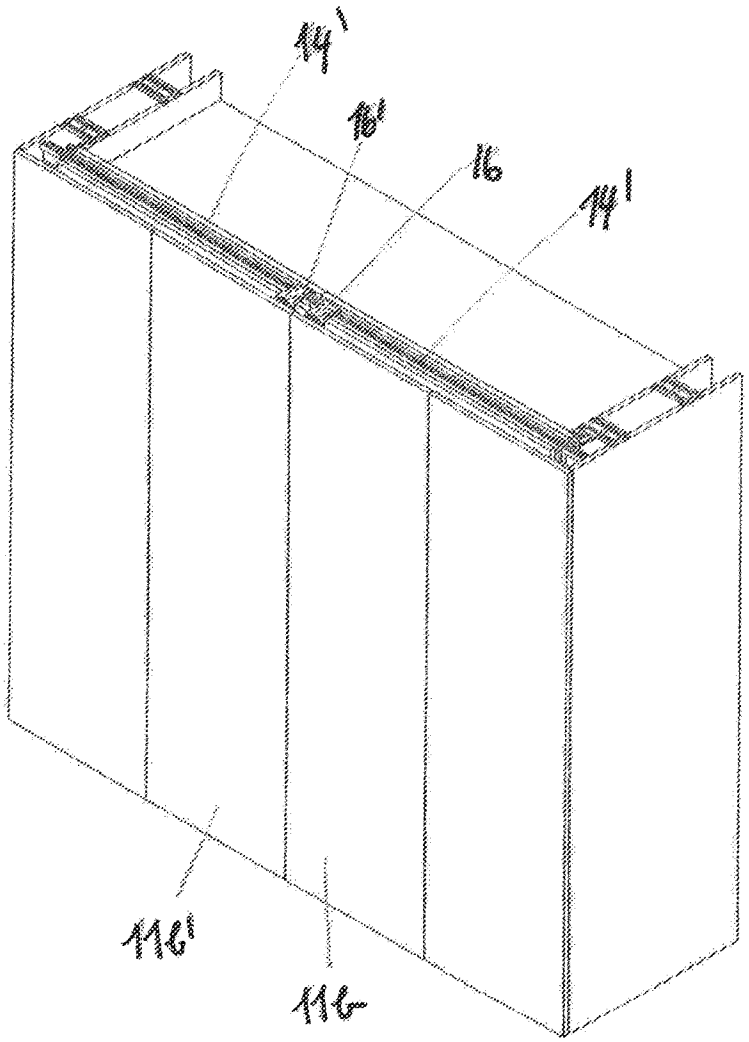

FIG. 19 once again shows the completely closed position which substantially corresponds to FIG. 11.

It will be appreciated that the invention is not limited to the illustrated embodiments, for example it is also possible for the guide system or the door arrangement according to the invention (pocket) to be arranged only at one side and not at two sides, as shown in the Figures.

The door also does not have to be a folding door. It is sufficient if the door is a normal pivotal door, although then the widthwise region to be covered is also less.

In the illustrated embodiment the slide 16 of the folding door 11 moves on to a slide stub 16*a* arranged at the upper end of the pillar 7 (see the detail A in FIG. 1). In that way the slide 16 of the folding door 11, that is parked on the slide stub 16*a* can move together with the pillar 7 into the receiving shaft 14. This is a "Park & Ride solution". Alternatively it is naturally also possible for the rail 14' to be extended round a curve into the shaft of the lateral guide system.

It will be appreciated that the furniture items can also differ from those illustrated. It is precisely a feature of the invention that the configuration of the furniture items, whether carcasses or electrical appliances, can be selected completely freely and independently of the lateral guide systems or door arrangements. Special carcasses as in the state of the art are not required.

The invention claimed is:

1. A furniture arrangement comprising a furniture item and a door arrangement arranged laterally beside the furniture item in a mounted state of the furniture arrangement, wherein the door arrangement comprises a support structure with a guide system, and a door mounted pivotably to the guide system, the guide system having a closed position in which a front side of the furniture item can be covered by the door, and a parked position in which the door is positioned in a lateral receiving shaft of the guide system, the door being moveable by means of the guide system in a transverse direction relative to a front of the furniture item and into the lateral receiving shaft so as to be in the parked position, wherein in the mounted state of the furniture arrangement, the door arrangement is independent of the furniture item to be covered, the support structure is separated from the furniture item, and is an autonomous and self-supporting support structure, and the furniture item is in direct contact with a wall of a room, and wherein the support structure includes a support surface for standing on a floor of the room or a mounting device for mounting to the wall of the room.

2. The furniture arrangement according to claim 1, wherein the guide system has a pillar to which the door is fixed by hinges, and the pillar is moveable or slidable on the support structure transversely relative to the front of the furniture item, and laterally beside the furniture item in forward and rearward directions.

3. The furniture arrangement according to claim 1, wherein the support structure has a vertically standing plate.

4. The furniture arrangement according to claim 3, wherein the support structure includes the support surface, and the support surface is provided or mounted at a lower end edge of the vertically standing plate.

5. The furniture arrangement according to claim 3, wherein the support structure includes the mounting device, and the mounting device is provided or mounted at a rear longitudinal edge of the vertically standing plate.

6. The furniture arrangement according to claim 3, wherein the support structure has a lateral cover plate.

7. The furniture arrangement according to claim 6, wherein the lateral cover plate is arranged parallel to the vertically standing plate, and wherein the lateral receiving shaft for the door is provided between the cover plate and the vertically standing plate.

8. The furniture arrangement according to claim 7, wherein the lateral cover plate is arranged parallel to the vertically standing plate by way of angle spacers.

9. The furniture arrangement according to claim 1, wherein the guide system for the door is arranged in an interior of the lateral receiving shaft.

10. The furniture arrangement according to claim 1, wherein the door is mounted releasably to the guide system.

11. The furniture arrangement according to claim 10, wherein the door is in the form of a folding door having first and second door leaves, wherein the first and second door leaves are pivotably connected together by way of folding door hinges, and the first door leaf is connected to the guide system.

12. The furniture arrangement according to claim 11, wherein the second door leaf is hingedly connected in an upper region to a slide displaceable in a rail which is connected to the support structure.

13. The furniture arrangement according to claim 1, wherein the furniture item is one of at least two mutually juxtaposed furniture items.

14. The furniture arrangement according to claim 13, wherein the at least two furniture items stand in a mutually juxtaposed relationship in a row to form a line.

15. The furniture arrangement according to claim 13, wherein the at least two furniture items are mutually juxtaposed laterally and are of substantially cuboidal outside dimensions.

16. The furniture arrangement according to claim 15, wherein a width of the at least two mutually juxtaposed furniture items is selected from a predetermined width module.

17. The furniture arrangement according to claim 1, wherein the door arrangement is one of a plurality of door arrangements, each of the door arrangements being arranged beside a respective lateral side of the furniture item.

18. The furniture arrangement according to claim 1, wherein the door of the door arrangement lies in one plane in the closed position of the guide system and covers the furniture item.

19. The furniture arrangement according to claim 18, wherein the door of the door arrangement also covers the support structure at the front side of the furniture item in the closed position of the guide system.

20. The furniture arrangement according to claim 1, wherein the furniture item has a furniture carcass with two parallel vertical side walls.

21. The furniture arrangement according to claim 1, wherein the furniture item is an electrical appliance.

22. The furniture arrangement according to claim 1, wherein the furniture item stands on the floor of the room.

23. The furniture arrangement according to claim 1, wherein the furniture item is hung on the wall of the room.

24. A method of mounting the furniture arrangement according to claim 1, comprising:

placing or fixing the support structure on the floor of the room or to the wall of the room, wherein the support structure has the guide system for linearly moveable and pivotable mounting of the door, and after the placing or fixing of the support structure, placing or fixing the furniture item directly laterally beside the support structure so as to be in direct contact with the wall of the room, and so as to be separated from the support structure.

25. The method according to claim 24, wherein the support structure is one of two support structures which are placed so as to be spaced from each other on the floor or on the wall, wherein each support structure is provided with a respective guide system for a respective door, and after the placing of the two support structures, the furniture item is placed so as to be in direct contact with the wall of the room.

26. The method according to claim 24, wherein the door is connected to the guide system before the placing or fixing of the support structure.

27. The method according to claim 24, wherein the door is connected to the guide system after the placing or fixing of the furniture item.

28. A method of mounting the furniture arrangement according to claim 1, comprising:

placing or fixing the furniture item to be covered so as to be in direct contact with the wall of the room, and after the placing or fixing of the furniture item, placing or fixing the support structure on the floor of the room or on the wall of the room directly beside the furniture item so as to be separated from the furniture item.

* * * * *